US009241575B2

(12) United States Patent
Wang

(10) Patent No.: US 9,241,575 B2
(45) Date of Patent: Jan. 26, 2016

(54) SOFA WITH SHIPPING AND USE CONFIGURATION

(71) Applicant: Ashley Furniture Industries, Inc., Arcadia, WI (US)

(72) Inventor: Walter Wang, Kunshan (CN)

(73) Assignee: Ashley Furniture Industries, Inc., Arcadia, WI (US)

( * ) Notice: Subject to any disclaimer, the term of this patent is extended or adjusted under 35 U.S.C. 154(b) by 168 days.

(21) Appl. No.: 13/752,248

(22) Filed: Jan. 28, 2013

(65) Prior Publication Data

US 2013/0193728 A1 Aug. 1, 2013

Related U.S. Application Data

(60) Provisional application No. 61/591,877, filed on Jan. 28, 2012.

(51) Int. Cl.

| | |
|---|---|
| ***A47C 17/04*** | (2006.01) |
| ***A47C 31/00*** | (2006.01) |
| ***A47C 7/40*** | (2006.01) |

(52) U.S. Cl.

CPC ..... *A47C 17/04* (2013.01); *A47C 7/407* (2013.01); *A47C 31/00* (2013.01)

(58) Field of Classification Search

CPC ..... A47C 17/04; A47C 7/407
USPC ..... 297/440.1, 440.14, 440.15, 440.2, 350
See application file for complete search history.

(56) References Cited

U.S. PATENT DOCUMENTS

| | | | | |
|---|---|---|---|---|
| 5,171,064 | A * | 12/1992 | Boussaroque | 297/391 |
| 5,678,897 | A * | 10/1997 | Prestia | 297/440.15 |
| 5,738,414 | A * | 4/1998 | Wieland et al. | 297/440.1 |
| 6,241,317 | B1 | 6/2001 | Wu | |
| 6,637,812 | B2 | 10/2003 | Laughlin et al. | |
| 6,779,845 | B1 * | 8/2004 | Lin et al. | 297/284.4 |
| 2002/0093235 | A1 * | 7/2002 | Niederman et al. | 297/440.1 |
| 2008/0185897 | A1 * | 8/2008 | Griggs | 297/440.1 |
| 2010/0270844 | A1 * | 10/2010 | Hood | 297/440.15 |
| 2012/0248836 | A1 * | 10/2012 | Lejcher et al. | 297/232 |

FOREIGN PATENT DOCUMENTS

| | | |
|---|---|---|
| WO | WO 01/58314 A1 | 8/2001 |

* cited by examiner

*Primary Examiner* — David R Dunn
*Assistant Examiner* — Jody Giacoman

(57) ABSTRACT

A ready to assemble or knockdown sofa having a back rest that can be reconfigured between a use configuration in which the sofa has a conventional L-shaped cross-section and a shipping or storage configuration in which the sofa is arranged in a more efficiently stacked rectangular cross-section. The rectangular cross-section allows the sofa to be more efficiently stacked with other sofas during shipping or storage. The back rest has an upper back rest portion and a lower back rest portion in which the upper back rest portion can be rotated forward toward the front of the sofa and downwardly into a nesting region against the top of the seat base to provide a more efficient shape.

19 Claims, 6 Drawing Sheets

SOFA WITH SHIPPING AND USE CONFIGURATION

RELATED APPLICATION

The present application claims priority to U.S. Provisional Patent Application No. 61/591,877 entitled SOFA WITH SHIPPING AND USE CONFIGURATION and filed Jan. 28, 2012, which is incorporated herein in its entirety.

FIELD OF THE INVENTION

The present invention is directed to a sofa that can be reconfigured between a use configuration and a shipping or storage configuration, wherein the shipping or storage configuration defines a more regular and compact geometric shape for more efficient shipping or storage of multiple sofas.

BACKGROUND OF THE INVENTION

Furniture items used for seating typically comprise an upholstered and/or cushioned support structure for supporting the user's back and bottom. In particular, sofas typically comprise a seat base, a back rest and at least one arm rest. A common aesthetic and practical design consideration is assembling the subcomponents of the sofa with minimum gaps between the subcomponents to avoid strain on the fasteners from movement of the subcomponents and the aesthetically unpleasing appearance of the gaps. Accordingly, furniture items are typically fully assembled at the factory to ensure that the individual subcomponents are properly assembled and upholstered with minimal interspatial gaps.

The inherent drawback of assembling the furniture item at the factory is that the common L-shape of the assembled seating furniture typically prevents efficient packing of the furniture items for transport. Depending on the shape and size of the furniture item, the packing of the furniture item can result in a significant amount of dead space within the shipping container or truck. In addition to increasing the cost of transportation, the dead space can allow the furniture items to shift during transport resulting in safety risks, uneven weight distributions or damage to the furniture item. Although the furniture item can be boxed for shipment, the L-shaped cross-section creates portions of the box that are unsupported and likely to collapse damaging the box and underlying furniture item. Similarly, assembled furniture items can be awkwardly shaped and difficult to navigate into the home or other structure without significant positioning and reorienting of the furniture item. The awkward maneuvering and positioning of the furniture item required to move the furniture item into the structure can result in injury to the movers and/or damage to the furniture or the structure.

An approach to addressing the drawbacks of factory assembled furniture items comprises providing individually upholstered subcomponents as a ready to assemble ("RTA") furniture kit. The individual components can be more efficiently packed and the furniture item is able to be assembled in situ eliminating the need for navigating the furniture item through the building. However, the inherent challenge of providing RTA furniture kits is that the consumers who assemble the furniture kits are typically untrained and may not have ready access to the tools or training necessary to properly assemble the subcomponents. In addition, aligning the heavy subcomponents to install the fasteners for connecting the subcomponents can be difficult, particularly if a single individual is assembling the furniture item. If the fasteners are not properly installed the structural integrity of the furniture item could be compromised resulting in collapse and/or injury of users.

As such, there is a need for a means of providing furniture items that does not suffer from the drawbacks of factory assembled furniture and currently available RTA furniture kits. In RTA furniture, it is advantageous to minimize the number of components that need to be assembled, to have the assembly be simple, to provide the smallest possible shipping package, and the finished product be robust and sturdy.

SUMMARY OF THE INVENTION

The present invention is directed to an RTA or "knock-down" sofa comprising a seat base and a back rest that can be reconfigured between a use configuration in which the sofa has a conventional L-shaped cross-section and a shipping or storage configuration in which the sofa is arranged in a more efficiently stacked rectangular cross-section. The rectangular cross-section allows the sofa to be more efficiently stacked with other sofas during shipping or storage. In addition, the rectangular cross-section reduces the dead spaces created when an L-shaped sofa is inserted into a box that can collapse during shipping or storage. Specifically, the back rest having a front side and a rear side comprising an upper back rest portion and a lower back rest portion, the upper back rest portion having a first upward position and a second downward position. The upper back rest, when in the first upward position, comprises an engagement surface that is downwardly facing and that is substantially horizontal and confronts and engages an upwardly facing surface of the lower back rest portion. The upper back rest portion can be rotated forward toward the front of the sofa and downwardly into a nesting region against the top of the seat base about a pivot point provided by a hinge positioned at or proximate the front side of the back rest. In certain embodiments, the bottom of the upper back rest portion and the top of the lower back rest portion are positioned in a generally planar horizontal orientation when the upper back rest portion is rotated into the storage configuration.

The horizontal surface created by the rotation of the upper back rest portion into the lowered position provides a support surface that can support a portion of the box wall to prevent collapse of the box due to dead spaces formed by an irregularly shaped sofa. In certain embodiments, the combined width of the engagement surfaces of the upper back rest portion and the lower back rest portion can be at least four inches. In other embodiments, the combined width can be at least six inches. In other embodiments, the combined width can be at least eight inches. In these configurations, the engagement of the front faces of the upper back rest portion and the lower back rest portion prevents over-rotation of the upper back rest portion presenting a stable horizontal surface for supporting the box wall. In certain embodiments, the vertical length of the front faces of the upper back rest portion and the lower back rest portion is at least six inches to provide sufficient support for the horizontal support surface. In other embodiments, the vertical length is at least eight inches. In yet other embodiments, the vertical length is at least ten inches.

In some embodiments, each hinge comprises at least two leaf portions having a plurality of alternating knuckles and a pin or a spindle threaded through the knuckles. One of the leaf portions is affixed to the bottom of the upper back rest portion, while the opposing leaf portion is affixed to the top of the lower back rest portion. When the upper back rest is in the downward position, the leaf portions define a plane, wherein the knuckles are offset from the plane such that the knuckles defining a barrel are positioned above the plane. When the upper back rest is in the upward position, the leaf portions are overlaying one another and are parallel or defining a slightly converging angle. The slightly converging angling also then is provided to the engagement surface of the upper back rest portion and upwardly facing surface of the lower backrest portion. Such angling increases the amount of force necessary to initiate the rotation of the upper back rest portion forward reducing the likelihood that the upper back rest portion will be inadvertently rotated into the stored configuration. Other hinge configurations may also be used.

In some embodiments, the sofa can comprise removable back rest cushions that can be removed from the back rest before the upper back rest portion is rotated into the storage configuration. The back rest cushions can comprise Velcro, zippers, buttons, compression straps or other conventional means of releasably securing the backrest cushions to the back rest. In this configuration, the back rest cushions can be positioned on the seat base or seat cushions to fill in any dead space and provide the rectangular cross-section.

In some embodiments, the seat base can define an interior space for receiving the back rest cushions, and/or scat cushions can be stored within the interior space during storage or transport. In this configuration, the sofa can further comprise a removable or replaceable sheeting secured to the seat base to enclose the interior space defined by the interior space. Alternatively, the sheeting can define at least one opening for accessing the interior space and can have a closeable flap secured by a Velcro, zipper, button or other conventional releasably securing means.

In some embodiments, the sofa can further comprise arm rests affixable to sides of the seat base. Each arm rest can comprise an engagement bracket slidably engagable to a corresponding bracket affixed to the seat base that aligns the arm rest with the seat base and secures the arm rest to the seat base. Each arm rest can also comprise at least one fastener insertable through the seat base from the interior base to secure the arm rest to the seat base. In some embodiments, the arm rests can be positioned in the interior space during shipping or storage to minimize the footprint of the sofa.

An RTA sofa, according to an embodiment of the present invention, comprises a seat base and a back rest. The seat base further comprises a rectangular frame comprising a top side, a front side, a back side, a left side and a right side and defining an interior space. The back rest is affixable to the back side of the seat base and comprises an upper back rest portion, a lower back rest portion and at least one hinge, wherein the upper back rest portion is rotatably secured to the lower back rest portion by the hinge and the lower back rest portion is affixed to the back side of the seat base. The hinge can comprise two leaf portions each having a plurality of interlocking knuckles for rotatably receiving a spindle or pin. In some embodiments, the sofa can further comprise at least one arm rest affixable to either the left or right side of the seat base.

In operation, the upper back rest portion is rotatable between an upright position in which the upper back rest portion is positioned above the lower back rest portion to define a continuous surface for receiving the user's back and a lowered position in which the upper back rest portion is positioned flush with or below the lower back rest. In some embodiments, the upper back rest portion is rotatable between 150 and 190 degrees. In other embodiments, the upper back rest is rotatable between 170 and 185 degrees. In some embodiments, the lower side of the upper back portion and the upper side of the lower back portion are substantially planar when the upper back portion is rotated into the lowered position, thereby maximizing storage efficiency.

In an embodiment of the invention, a boxed RTA sofa has a seat base with a lower back rest portion permanently affixed thereto, and a hinged upper backrest portion folded down toward the seat base. The lower back portion and hinged upper backrest provide a horizontal surface for facing an upper surface of the box. In some embodiments, a pair of to-be-attached armrests is stowed in the seat base and is accessible out of the bottom of the base when removed from the box. In some embodiments, a pair of to-be-attached armrests are stowed in the box on top of the seat cushions and back rest cushions are stowed in the seat base. To-be-attached feet may be stowed in the base as well.

In an embodiment of the invention, a boxing rectilinear profile is defined by the fixed base and integral lower portion of the back rest with the arm rests removed. All other components are fittable in the rectilinear profile in a box. In some embodiments, the other components are seat cushions, back rest cushions, side arms, assembly hardware, instructions.

In an embodiment of the invention, a boxing rectilinear profile is defined by the fixed base and integral lower portion of the back rest and with integral arm rests. All other components are fittable in the rectilinear profile in a box matching the rectilinear profile. In some embodiments, the other components are seat cushions, back rest cushions, assembly hardware, instructions.

A feature and advantage of certain embodiments of the invention is that the components may be shipped in a smaller box than the conventional box, compared to other RTA designs that provide a comparably sized finished sofa.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1A:
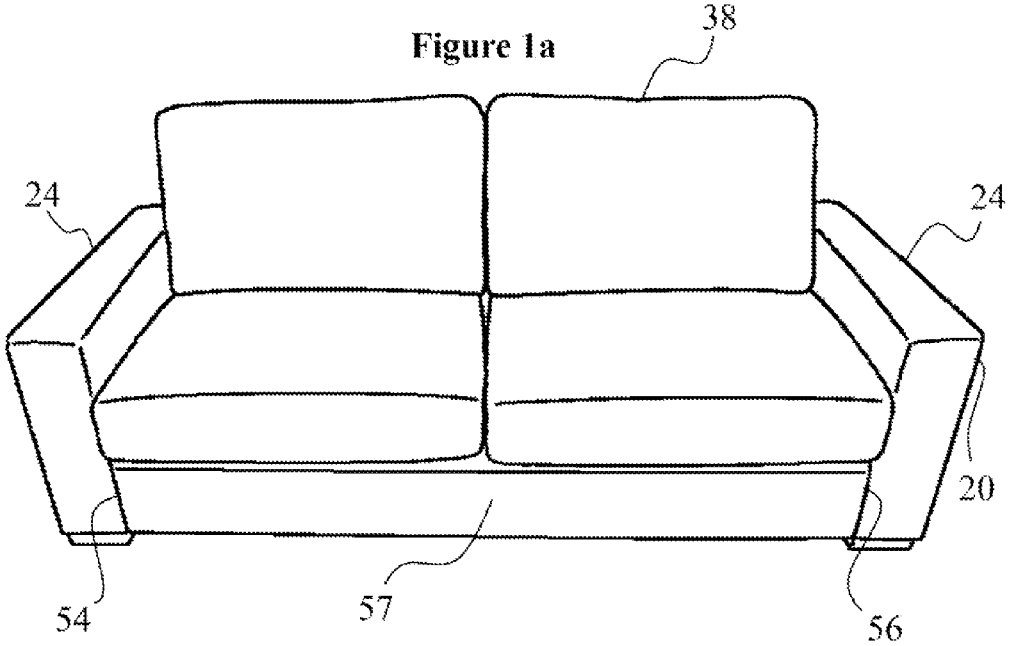
FIG. 1*a* is a front perspective view of a sofa in a use position according to an embodiment of the present invention.
Figure 1B:
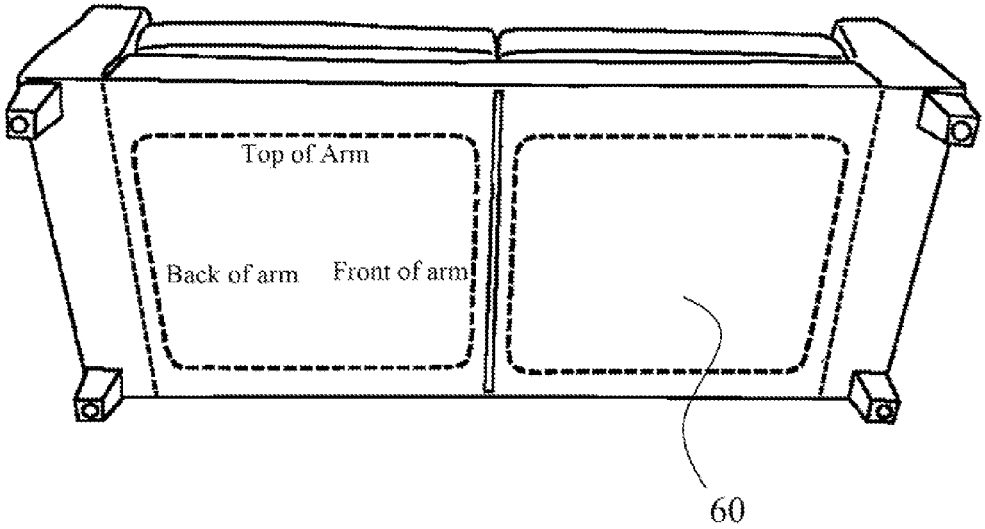
FIG. 1*b* is a bottom view of a sofa, particularly the seat base, illustrating stowage regions according to an embodiment of the present invention.
Figure 1C:
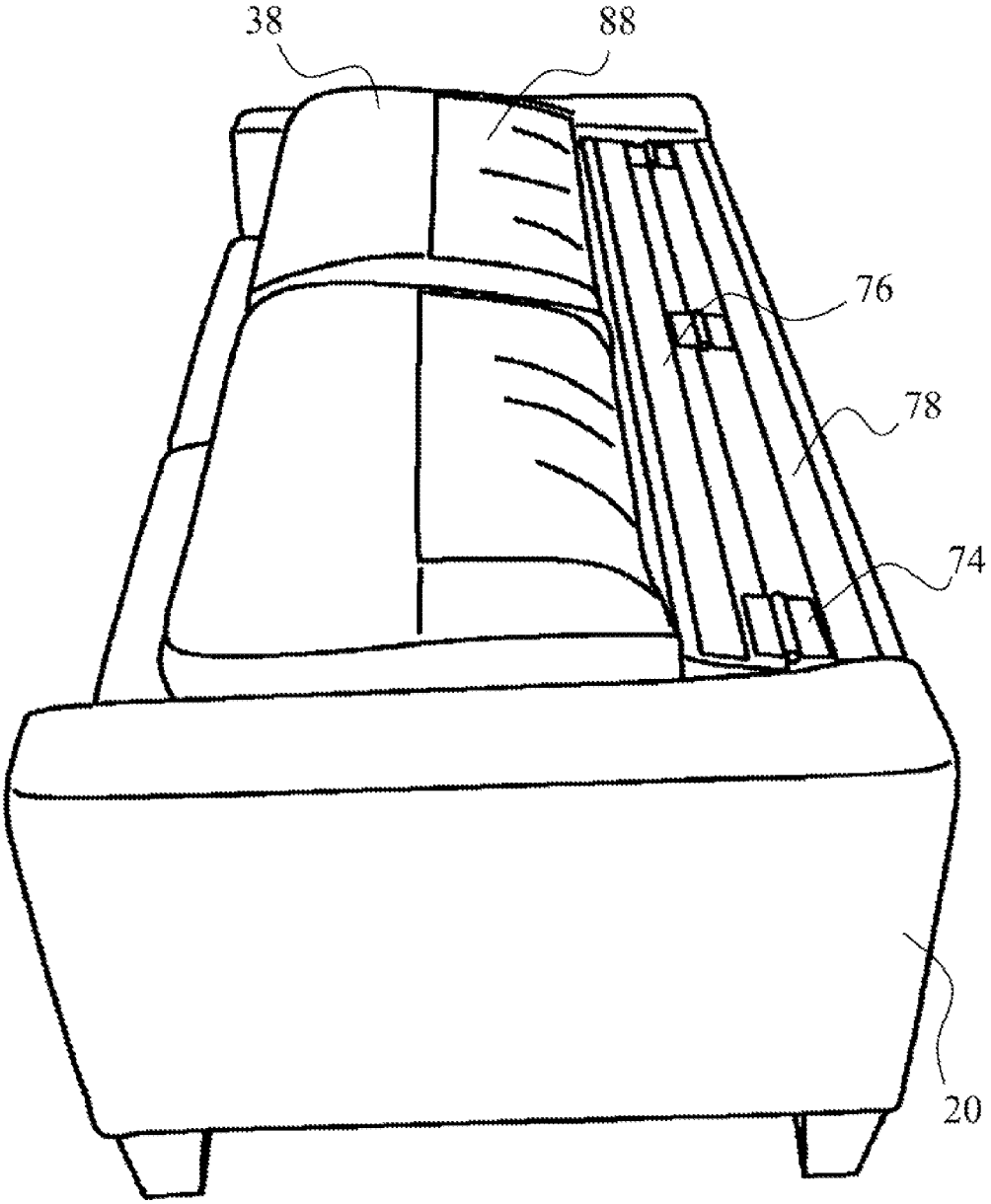
FIG. 1*c* is a side perspective view of a sofa in a storage or shipping configuration with the hinged top portion of the back rest pivoted downwardly in a storage or shipping configuration according to an embodiment of the present invention.

While the invention is amenable to various modifications and alternative forms, specifics thereof have been shown by way of example in the drawings and will be described in detail herein. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

As depicted in FIGS. 1-4, a sofa 20, according to an embodiment of the present invention, comprises a seat base 22 and an upright lower back rest portion 30 integral with the scat base. "Integral" in that they are fixed together at the factory with permanent fasteners, glue, and may have common frame members and they are not detachable from one another without damage. Moreover, the upholstery may run continuously between the base and lower back rest portion. In some embodiments, the sofa 20 can further comprise a pair of arm rests 24, 26. The seat base 22 comprises a box frame 40 comprising a rectangular shape and having a left side 54, a left side outwardly facing surface 55, a right side 56, a right side outwardly facing surface 58, a front side 57, and a front side outwardly facing surface 59. The back side 68 comprises a back side outwardly facing surface 69, a bottom side 60, and a top 50 comprising a top surface 52. The box frame 40 defines an open interior space 62. In some embodiments, the seat base 22 can further comprise upholstery 46, scat springs 42 and seat stretchers 44. In other embodiments, the seat base 22 comprises wood or wood products.

Figure 2:
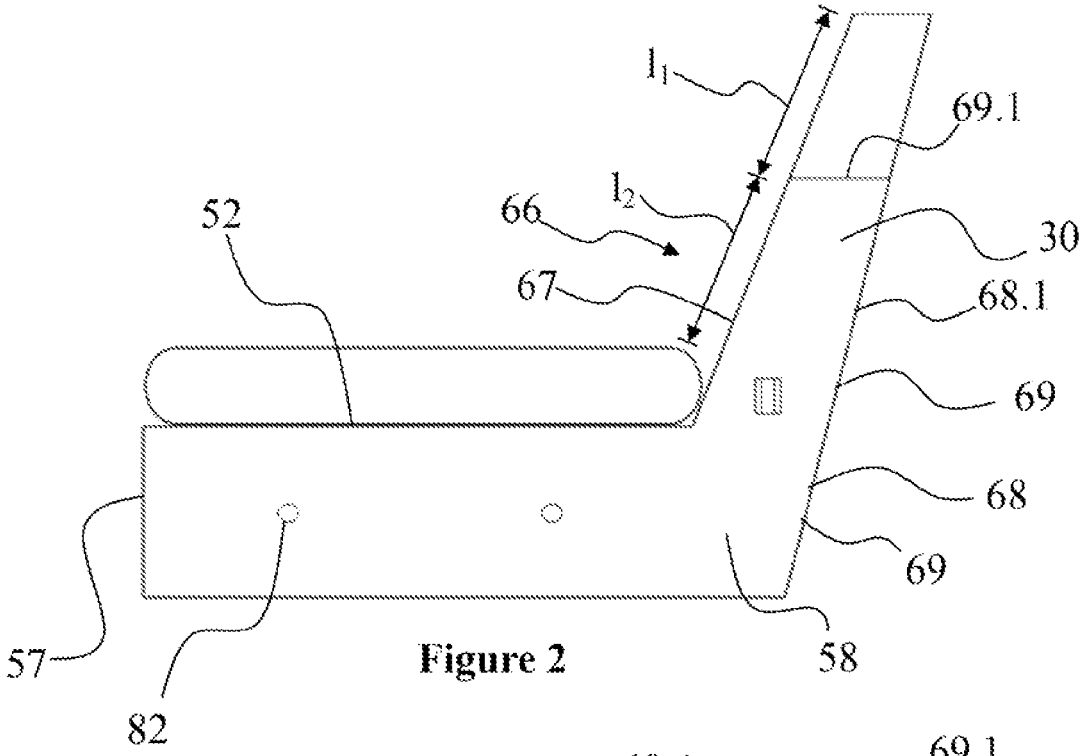
FIG. 2 is a side view of a base and lower back portion and a raised upper back portion according to the invention described herein.
Figure 3:
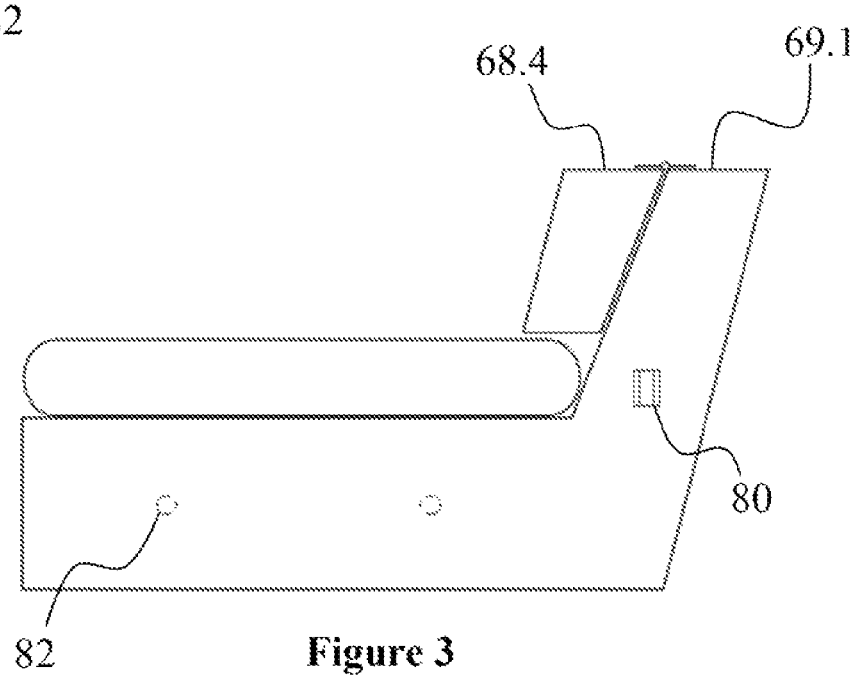
FIG. 3 is a side view of a base and lower back portion and a lowered upper back portion according to the invention described herein.
Figure 4:
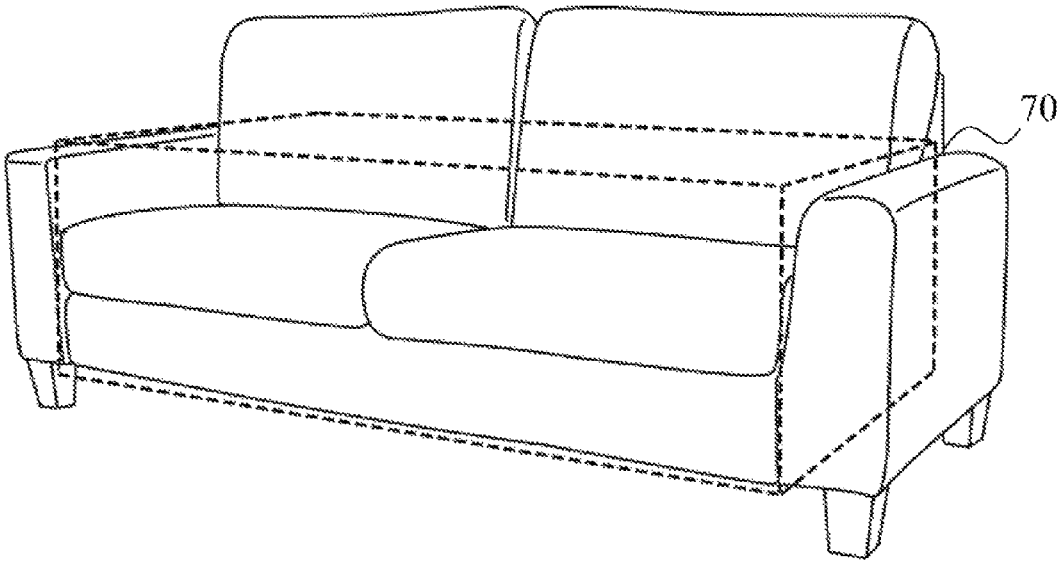
FIG. 4 is a perspective view of a sofa illustrating the sizing of a box that would contain said sofa when in a shipping configuration according to an embodiment of the present invention.

As depicted in FIGS. 1-4, the lower back rest portion 30 comprises a front side 66, a front surface 67, a back side 68, a back side surface 69, and an upwardly facing horizontal surface 69.1 that is a seating surface for an upper back rest portion 70. The lower back rest portion 72 is affixed to the back side 68 of the seat base 22. The upper back rest portion 70 is pivotally attached to the lower back rest portion 72 with at least one hinge 74. The upper back rest portion 70 has an upright position where it is seated and secured to the lower back rest portion as shown in FIGS. 2 and 4. In said position the upper back rest portion 70 has an upper forward surface 68.1 and an upper rearward surface 68.2 and has a downward facing horizontal surface 68.4. The upper back rest portion also has a lowered downward folded position as shown in FIGS. 1C, 3, 7, and 8. In the upright position, the front surface 67 of the lower back rest portion 72 is aligned with the front surface of the upper back rest portion, and the rearward surface of the upper back rest portion 70 is in alignment with the rearward surface of the lower back rest portion 70 and the rearward surface of the base. In the folded position the horizontal surface 68.4 is aligned with the horizontal surface 69.1 of the lower back rest portion 70 to define a continual horizontal surface for supporting a box or stacked sofa 20.

In certain embodiments, the combined width of the horizontal surface 68.4 of the upper back rest portion 70 and the horizontal surface 69.1 can be at least four inches. In other embodiments, the combined width can be at least six inches. In other embodiments, the combined width can be at least eight inches. The engagement of the forward surface 68.1 of the upper back rest portion 70 with the front surface 67 of the lower back rest portion 72 prevents further rotation of the upper back rest portion 70 allowing the horizontal surface 68.4 of the upper back rest portion 70 to support a box wall. In certain embodiments, the vertical length of the engagement portion between the upper back rest portion 70 and the lower back rest portion 72 is at least six inches. In other embodiments, the vertical length of the engagement portion is at least eight inches. In other embodiments, the vertical length of the engagement portion is at least ten inches.

The hinge 90 may comprise at least two leaf portions 92 and a pin 94. Each leaf portion 92 comprises a plurality of knuckles 96 arranged in an alternating fashion with the knuckles 96 of the opposing leaf portion 92 such that the pin 94 can be inserted through the knuckles 96 to rotatably secure the leaf portions 92 together. Each leaf portion 92 defines a plane, wherein the knuckles 96 are offset from the plane defined by the leaf portion 92. Other hinges may include sheet material, fabric, or polymer living hinge. In operation, one leaf portion 92 is affixed to the upper back rest portion 70, while the opposing leaf portion 92 is affixed to the lower back rest portion 72 such that the upper back rest portion 70 is rotatable with respect to the lower back rest portion 72. The upper back rest portion 70 is rotatable between the upright position in which the upper back rest portion 70 is positioned over the lower back rest portion 72 to define a conventional L-shaped seating shape and a lowered position in which the upper back rest portion 70 is rotated forwardly and downwardly such that the upper back rest portion and lower back rest portion folded together define a generally rectangular or rhombus or quadrilateral cross-section. In the upright position, the offset arrangement of the knuckles 96 angles the upper back rest portion 70 slightly downward in the rearward direction to minimize the risk that the upper back rest portion 70 inadvertently rotates toward the lowered position when a user is seated on the sofa 20. In embodiments, the upper back rest portion 70 can further comprise a securing element 76, while the lower back rest portion 72 can further comprise a cooperating securing element 78. Hook and loop strips, known as Velcro material are suitable for the securing elements. In this configuration, the cooperating securing elements 76, 78 are positioned such that the securing elements 76, 78 are engaged together securing the upper back rest portion 70 to the lower back rest portion 72 when the upper back rest portion 70 is positioned in the upright position. As illustrated, the upper back rest portion 70 is rotated such that the front side 66 of the upper back rest portion 70 is positioned against the front side 66 of the lower back rest portion 72.

Figure 5:
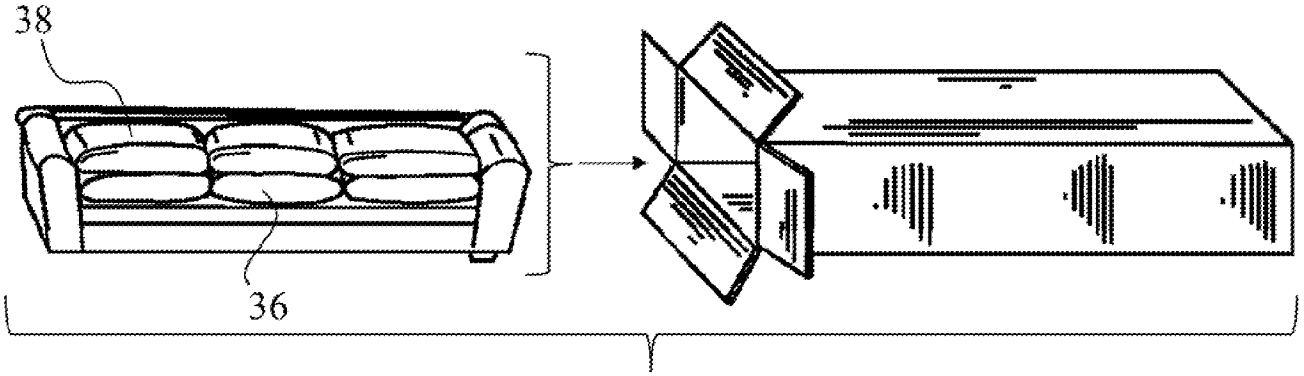
FIG. 5 is a pictorial view of a sofa according to an embodiment of the present invention in a shipping configuration.
Figure 6:
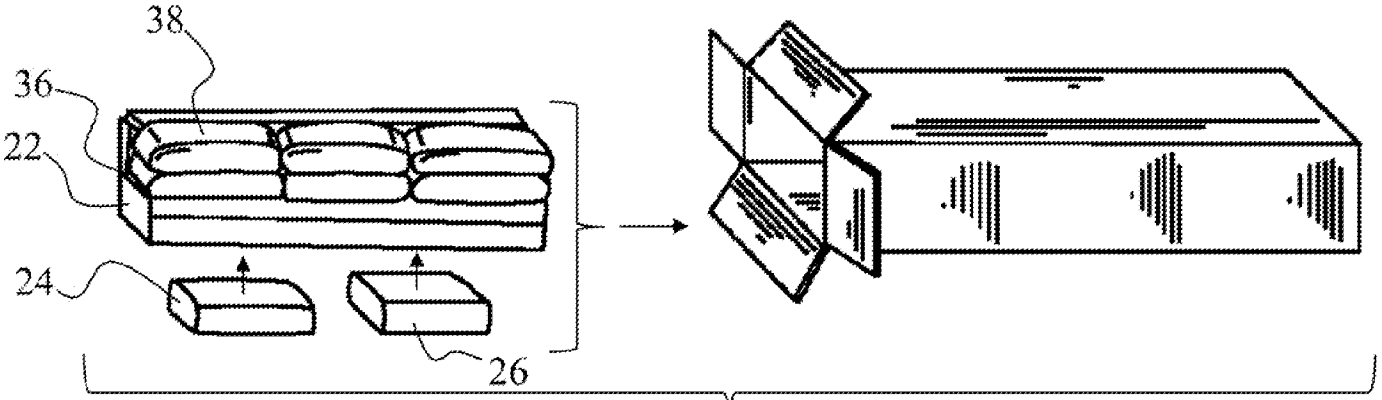
FIG. 6 is a pictorial view of a sofa according to an embodiment of the present invention in a shipping configuration.
Figure 7:
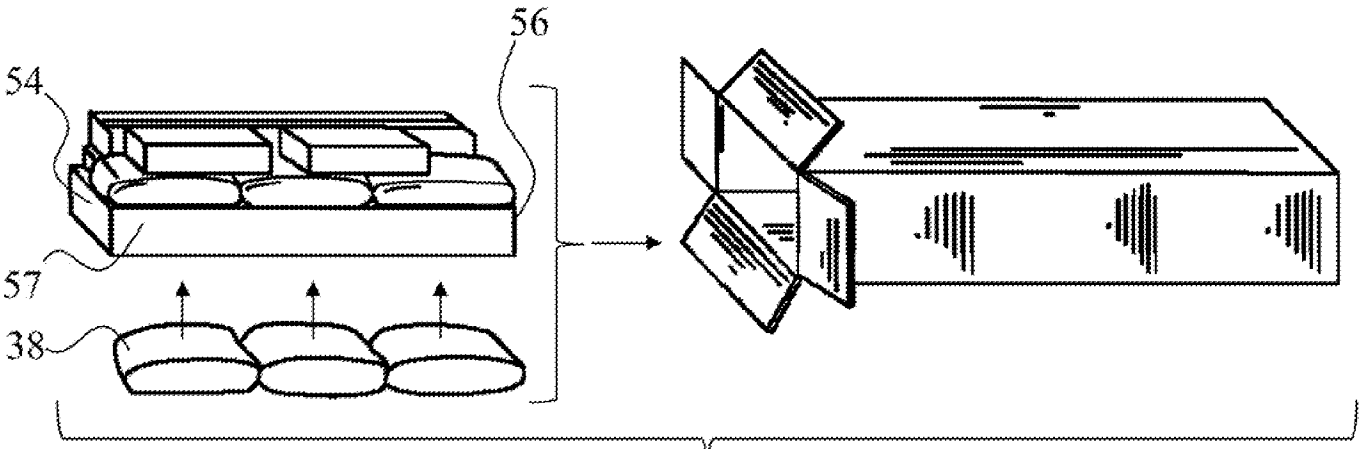
FIG. 7 is a pictorial view of a sofa according to an embodiment of the present invention in a shipping configuration.
Figure 9:
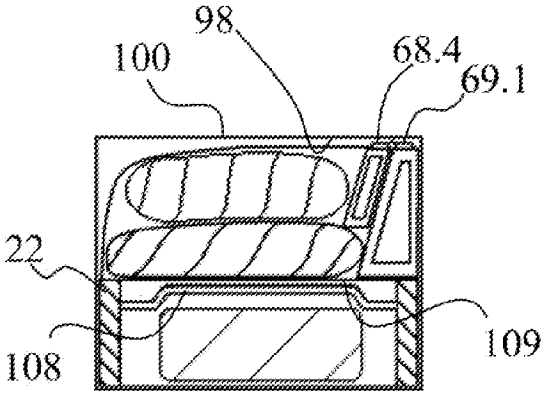
FIG. 9 is a cross-sectional view through a packaged sofa in a box according to an embodiment of the present invention.
Figure 8:
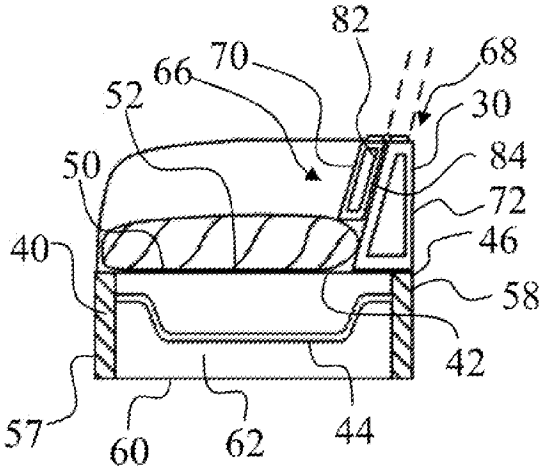
FIG. 8 is a cross-sectional view through a sofa with the back rest rotated downwardly according to an embodiment of the present invention.

As depicted in FIGS. 5-7, the sofa 20 can further comprise at least one back rest cushion 38 affixable to the front side 66 of the back rest 30. In this configuration, the back rest cushion 38 can further comprise a releasable securing element 88 for releasably securing the back rest cushion 30 to the front side 66 of the back rest 30. The releasable securing element 88 can comprise Velcro, a zipper, a button or other conventional means of releasably securing the back rest cushion 30 to the back rest 30. In this configuration, the back rest cushions 38 can be removed from the back rest 30 and stored within the interior space 62. Alternatively, the back rest cushions 38 can be positioned on the top 50 of the scat base 22 or on a seat cushion 36 secured to the top 50 of the seat base 22 to fill the dead space and create a rectangular cross-section for efficient packing.

Referring to FIGS. 2 and 3, and generally the other figures, the arm rests 24, 26 can be attached to the left side 54 and the right side 56 of the box frame 40. In embodiments, the arm rests 24, 26 can be releasably secured to the seat base 22 and lower back rest such that the arm rests 24, 26 can be separated from the seat base 22 and stored within the interior space 62 during shipping or storage. The arm rests 24, 26 can be secured with corresponding alignment brackets 80, fasteners extending through respective walls or brackets of the arm rests and seat base apertures 82 and other known means.

When used herein, "removably attachable" means without damage to the respectable components using brackets and threaded connectors.

As illustrated in FIGS. 4-8, the configuration described herein provides significant packaging advantages. The lower base portion fixed to the base provides an inherently strong robust rectilinear box shape structure ideal for shipping. Securing the otherwise protruding armrests below the base provides a secure location for them. The two horizontal faces on each side of the hinge of the upper and lower back rest portions provide a structurally sound surface abutting, typically with padding, the inside surface 98 of the box 100. A rotatable seat stretcher 108 may be rotated upwardly to accommodate stowage in the base and rotated downward to provide clearance for spring travel.

While the invention is amenable to various modifications and alternative forms, specifics thereof have been shown by way of example in the drawings and described in detail herein. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A boxed knock down sofa in a shipping configuration and having a use configuration, the boxed knock down sofa comprising:

a box;

a seat base in the box, the seat base having a rectangular foot print, a top side, a bottom side, a front side, a back side, a left side and a right side, the seat base defining an open interior space;

a plurality of seat cushions in the box and sized for the top side of the seat base;

a pair of arm rests in the box, the pair of arm rests removably attachable on the left side and right side of the seat base;

a seat back rest portion permanently attached to and extending upwardly at the back side of the seat base, the seat back rest portion having an upper back portion and a lower back portion hinged together, and the upper back portion is folded forwardly and laying on a front surface of the lower back portion whereby, the upper back portion is rotatable upwardly, when removed from the box, to the use configuration whereby a front surface of the upper back portion is positioned above and is aligned with the front surface of the lower back portion, in a shipping configuration; and a plurality of back cushions in the box, whereby when the sofa is in the use configuration, the plurality of back cushions are positioned upright and forward of and covering the front side of the lower back portion and the front side of the upper back portion.

2. The boxed knock down sofa of claim 1, wherein the seat back rest portion has a taper going upwardly when the upper back portion is in the upright use position.

3. The boxed knock down sofa of claim 1, wherein the rotation of the upper back portion with respect to the lower back portion is at least 160 degrees.

4. The boxed knock down sofa of claim 1, wherein the upper back portion, when in the upright use position, has a downwardly facing flat surface that is elongate and rectangular and that corresponds to and abuts against a like sized upwardly facing surface on the lower back portion.

5. The boxed knock down sofa of claim 1, wherein the upper back portion and lower back portion are securable together in the upright use position by hook and loop fasteners.

6. The boxed knock down sofa of claim 1, wherein the pair of arm rests having a height, and the top surface of the lower back portion has a height and said height is positionable at or below the height of the arm rests when the arm rests are attached to the seat base, and the heights are within 20% of one another.

7. The boxed knock down sofa of claim 1, wherein the arm rests are removably attachable to the seat base by at a plurality of at least one of: a) bolts with manually turnable handles and b) vertically engagable brackets.

8. The boxed knock down sofa of claim 1, wherein the arm rests are removably attachable to the seat base and are stowable within the seat base during storage or shipment.

9. The boxed knock down sofa of claim 1, wherein when the sofa is in the shipping configuration the upper back portion of the seat back rest portion is resting against the lower back portion of the seat back rest portion such that a back side of the upper back portion is facing forward and the back cushions are positioned against and forwardly of the back side of the upper portion.

10. The boxed knock down sofa of claim 1, wherein the upper back portion and lower back portion have cooperating surfaces with cooperating patches of hook and loop engagement material.

11. The boxed knock down sofa of claim 1, wherein the front side of the upper back portion has hook and loop material and the plurality of back cushions each have cooperating hook and loop material whereby the back cushions may be attached to a front side of the upper back portion of the seat back rest portion in the use position.

12. The boxed knock down sofa of claim 1, wherein the upper back portion is positioned above the seat cushions when in the shipping configuration.

13. The boxed knock down sofa of claim 1, wherein when the upper back portion is in the stowed position, a lower side when in the use position of the upper back portion and an upper side of the lower back portion are coplanar.

14. The boxed knock down sofa of claim 1, wherein when the upper back portion is in the stowed position, an upwardly horizontal surface of the upper back portion and an upper side of the lower back portion are substantially coplanar.

15. The boxed knock down sofa of claim 1, wherein the upper back portion and lower back portion, when the upper back portion is in the upright use position, each have a front side and a front side surface, and wherein when the upper back portion is in the shipping configuration, the front side surface of the upper back portion rests against the front side surface of the lower back portion.

16. The boxed knock down sofa of claim 1, wherein the seat cushions are removably placeable within the seat base with access from a removable sheet material cover on the bottom side of the seat base.

17. The boxed knock down sofa of claim 1, wherein the sofa has a shipping configuration and wherein in the shipping configuration the upper back portion rests against the lower back portion with the front side surface of the upper back portion resting against the front side surface of the lower back portion, and the seat cushions are stowed within the seat base and the side arms are detached and resting on the top of the seat base.

18. The boxed knock down sofa of claim 1, wherein the upper back portion and lower back portion each present an upwardly facing surface with a total width, front to back, of at least 4 inches.

19. The boxed knock down sofa of claim 1, wherein the sofa has a shipping configuration and wherein when in the shipping configuration the upper back portion rests against the lower back portion with the front side surface of the upper back portion resting against the front side surface of the lower back portion, and the seat cushions are on top of the seat base and the side arms are detached and stowed within the seat base.

* * * * *